US005998682A

United States Patent [19]

Chien

[11] Patent Number: 5,998,682

[45] Date of Patent: Dec. 7, 1999

[54] PROCESSES AND APPARATUS FOR ENERGY RECOVERING THROUGH WASTE CLASSIFICATION AND CALCINATION

[76] Inventor: Szu Jeng Chien, 5F., No.1, Alley 19, Lane 284, Wu-Hsing St., Taipei, Taiwan

[21] Appl. No.: 09/182,647

[22] Filed: Oct. 30, 1998

Related U.S. Application Data

[62] Division of application No. 08/859,425, May 20, 1997, Pat. No. 5,779,480.

[51] Int. Cl.[6] ..... C01G 1/00; C07C 1/00

[52] U.S. Cl. ..... 585/241; 585/240; 201/2.5; 201/25

[58] Field of Search ..... 585/240, 241; 201/2.5, 25

[56] References Cited

U.S. PATENT DOCUMENTS

| | | | |
|---|---|---|---|
| 4,175,211 | 11/1979 | Chen et al. | 585/241 |
| 5,057,189 | 10/1991 | Apffel | 202/113 |
| 5,445,088 | 8/1995 | Daugherty et al. | 110/346 |
| 5,608,136 | 3/1997 | Maezawa et al. | 588/228 |
| 5,756,871 | 5/1998 | Wang | 585/241 |

FOREIGN PATENT DOCUMENTS

| | | |
|---|---|---|
| 1017888 | 8/1992 | China . |
| 1078788 | 11/1993 | China . |
| 0448178 | 9/1991 | European Pat. Off. . |
| 1331777 | 9/1973 | United Kingdom . |

*Primary Examiner*—Bekir L. Yildirim
*Attorney, Agent, or Firm*—Smith, Gambrell & Russell, LLP; Beveridge, DeGrandi, Weilacher & Young Intellectual Property Group

[57] ABSTRACT

The invention provides a process for energy recovery through waste classification and calcination, and an apparatus therefor; the process comprises crushing and sorting various types of wastes, and by means of a series of classification, calcination and recovering treatments, recovering and reusing efficiently fuel oil, fuel gas and residues, as well as providing electric power and heat required for the apparatus in the self-supplying feedback system of the invention, and additionally, lowering successfully the secondary pollution from waste disposal.

9 Claims, 5 Drawing Sheets

PROCESSES AND APPARATUS FOR ENERGY RECOVERING THROUGH WASTE CLASSIFICATION AND CALCINATION

This application is a Divisional of Ser. No. 08/859,429, filed on May 20, 1997, now U.S. Pat. No. 5,779,480.

BACKGROUND OF THE INVENTION

1. Field of the Invention

The invention relates to a process for energy recovery through waste classification and calcination and to apparatus therefor, and in particular, to a process and apparatus for recovering high added-value converted products such as fuel oil, carbon ash, gases and refractory materials through classifying wastes into combustible wastes and plastics wastes and calcining the same.

2. Description of the Prior Art

Recently, due to diversification in ordinary life, wastes produced by families and factories constantly increase while their types become more complicated. It is known that treatments of different types of wastes are different. However, since sorting of wastes is difficult, the problem of waste disposal is increasingly severe and is a problem that must be resolved immediately.

Conventional waste treatment comprises calcination or landfill without first sorting and treating separately according to types of wastes. Such waste disposal not only pollutes the environment, but also, obviously, can not achieve the goal of energy recovery. Among the types of waste, plastic wastes have become mayor pollutants, owing to their natural undegradability and gradual accumulation. Conventional disposal of plastic wastes comprises calcining, or else sorting for recovery. Wherein, the calcination process consists of burning plastic waste directly, while the sorting recovery process comprises sorting plastic wastes and recovering the reclaimed plastics. The former is purely consumption engineering which requires expensive equipment for preventing secondary public nuisances such as air pollution, while the sorting recovery process has the problem of handling difficulties due to the great variety of types of plastics and additives contained therein. Also, the poor quality of the reclaimed products makes the recovery process impractical.

SUMMARY OF THE INVENTION

In view of conventional waste disposal processes which are used temporary convenience without considering future global ecological environment, the inventors have planned and studied extensively, and as a result, have designed a process for waste treatment and an apparatus therefor, wherein, after being treated by the apparatus according to the invention, wastes do not occupy space as is in the landfill process nor pollute the environment as in the calcination process. And, furthermore, by means of waste classification and calcination, the apparatus according to the invention can convert useless wastes into high added-value products such as fuel oil, carbon ash, gas and refractory materials so as to achieve the goal of energy recovery.

Accordingly, the object of the invention is to provide a process for recovering energy through waste classification and calcination, and to an apparatus therefor, which comprises applying a series of treatments, classification, calcination, and the recovering of wastes to be treated so as to efficiently recover fuel oil, fuel gases and reclaimed residues, and supply power and heat needed by the self-satisfying feedback system, as well as to reduce the possibility of secondary pollution from waste treatment.

BRIEF DESCRIPTION OF THE DRAWINGS

The invention, as well as its many advantages, may be further understood by the following detailed description and drawings in which.

EXPLANATION OF THE REFERENCE NUMBERS

Figure 1:
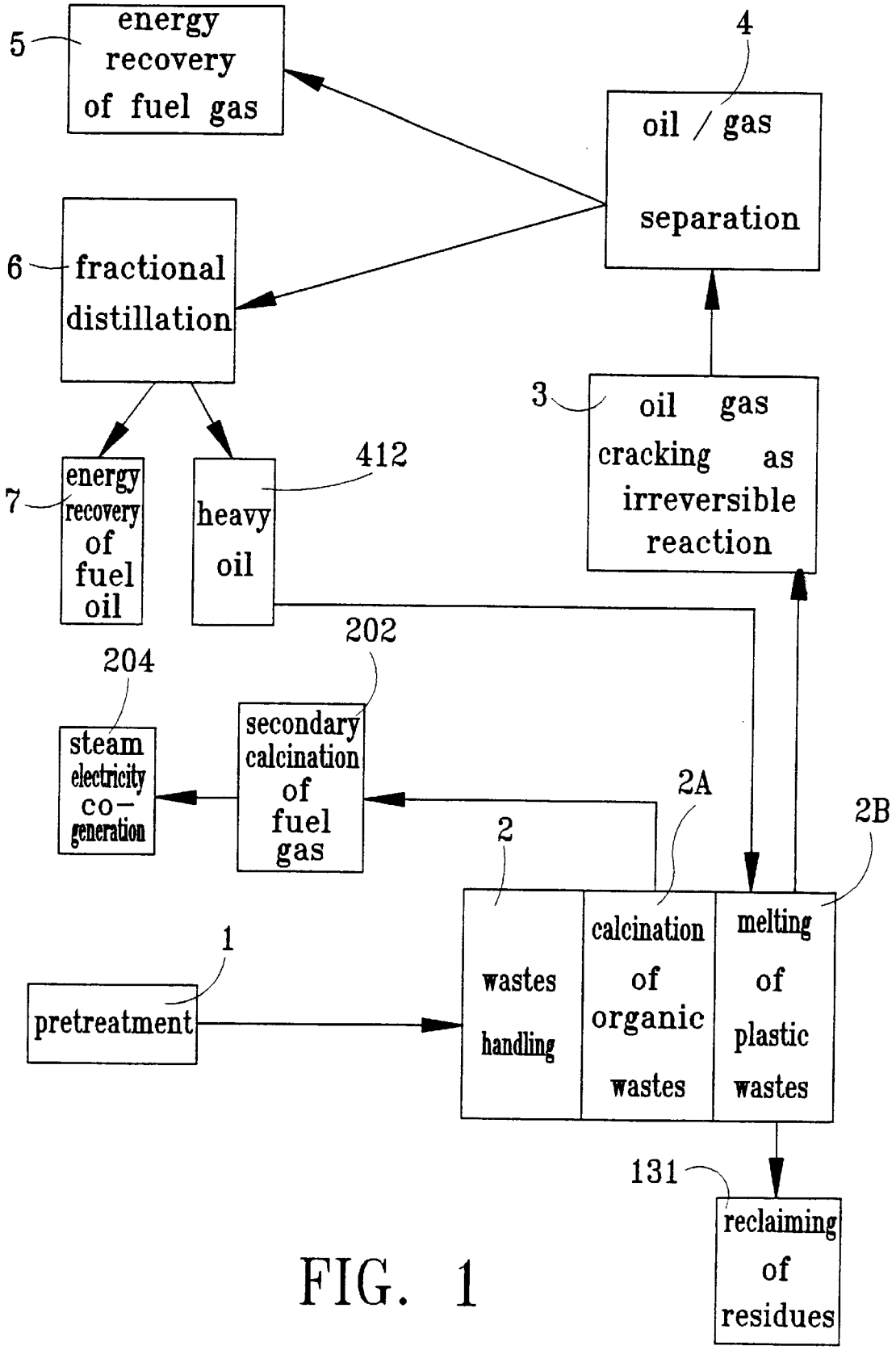
FIG. 1 is the flow sheet of the process for energy recovery through waste classification and calcination according to the invention.

(1) pretreatment
(10) wastes
(11) mixed wastes
(12) organic wastes
(121) ash
(13) light weight wastes
(131) residues
(2) waste treatment
(2A) calcination of organic wastes
(2B) heat melting
(20) calcination furnace
(201) furnace body
(202) secondary calcination furnace
(203) heat exchanger
(204) steam electricity co-generation system
(21) cracking furnace
(211) cooling water lines
(212) valve
(213) lid
(214) inlet
(22) calcination plate
(221) hole
(23) conveying lines
(24) heavy oil lines
(241) valve
(25) oil gas
(251) oil gas lines
(26) air lines
(261) air
(27) gas lines
(28) mobile plate
(29) hot flue gas
(291) hot flue gas lines
(3) irreversible cracking of oil gases
(31) reactor
(311) spacer
(312) screen plate
(32) first condenser
(33) second condenser
(34) precipitation tank
(35) waste water treator
(4) oil/gas separation
(40) oil/gas separation tank
(41) crude oil (411) distillate
(412) heavy oil
(413) distillate
(414) distillate
(42) fuel gas
(43) gas storing tank
(44) gas cylinder
(45) heavy oil storing tank
(5) fuel gas energy recovery
(6) fractional distillation
(60) fractionating column
(61) cooler
(62) distiller
(63) storage in first oil storing tank
(64) storage in second oil storing tank
(65, 66) washing tank
(67) diesel oil storing tank
(671) diesel oil
(68) gasoline storing tank
(681) advanced gasoline
(682) leadless gasoline
(7) diesel oil energy recovery
(9) garbage wagon
(90) conveying belt
(91) crusher
(911) pulverator
(92) conveying belt
(X,Y,Z) outlet

DETAIL DESCRIPTION OF THE PREFERRED EMBODIMENT

Referring to FIG. 1, the invention provides a process for energy recovery through waste classification and calcination, comprising the steps:

(1) Pretreatment

Crushing various waste (10) into crushed state and sorting the a crushed wastes based on specific gravity into: mixed waste (11), organic waste (12) and light weight plastic waste (13), etc. Among which, mixed waste (11) can be subdivided to separate metal for selling, while the remainder can be landfilled or made into artificial reef;

(2) Waste Treatment

The plastics-containing light weight waste (13) obtained from the pretreatment step (1) described above can be mixed with solvent and heat dissolving treatment conducted (2B), while organic waste (12) obtained from the pretreatment step (1) can be calcined with gas (2A) where the high temperature heat energy generated can be used in heat dissolving (2B) of the light weight waste (13), and in the cracking of plastics into oil gas (25);

(3) Irreversible Cracking of Oil Gas

Introducing oil gas (25) into a reactor (31) and carrying out irreversible reaction to cleave molecules under controlled temperature and pressure;

(4) Oil/Gas Separation

Collecting oil gas (25) obtained in above step (3) and cooling stepwise to near atmospheric temperature to condense and precipitate into a liquid state which is recovered as crude oil (41), while a part of the gases uncondensed is recovered as fuel gas (42);

(5) Fuel Gas Energy Recovery

Pressure liquifying fuel gas (42) obtained in step (4) described above can be stored or dispensed into cylinders for selling or providing heat for apparatus therein;

(6) Fractional Distillation

Crude oil (41) obtained from above step (4) can be heated, cooled, fractionally distilled and the distillate collected (413, 414);

(7) Energy Recovery from Fuel Oil

The distillates obtained from fractional distillation (6) described above can be subject to pickling, neutralizing and removing contaminants, then, precipitating to bleach, and then recovered as pure diesel oil or gasoline.

Figure 2:
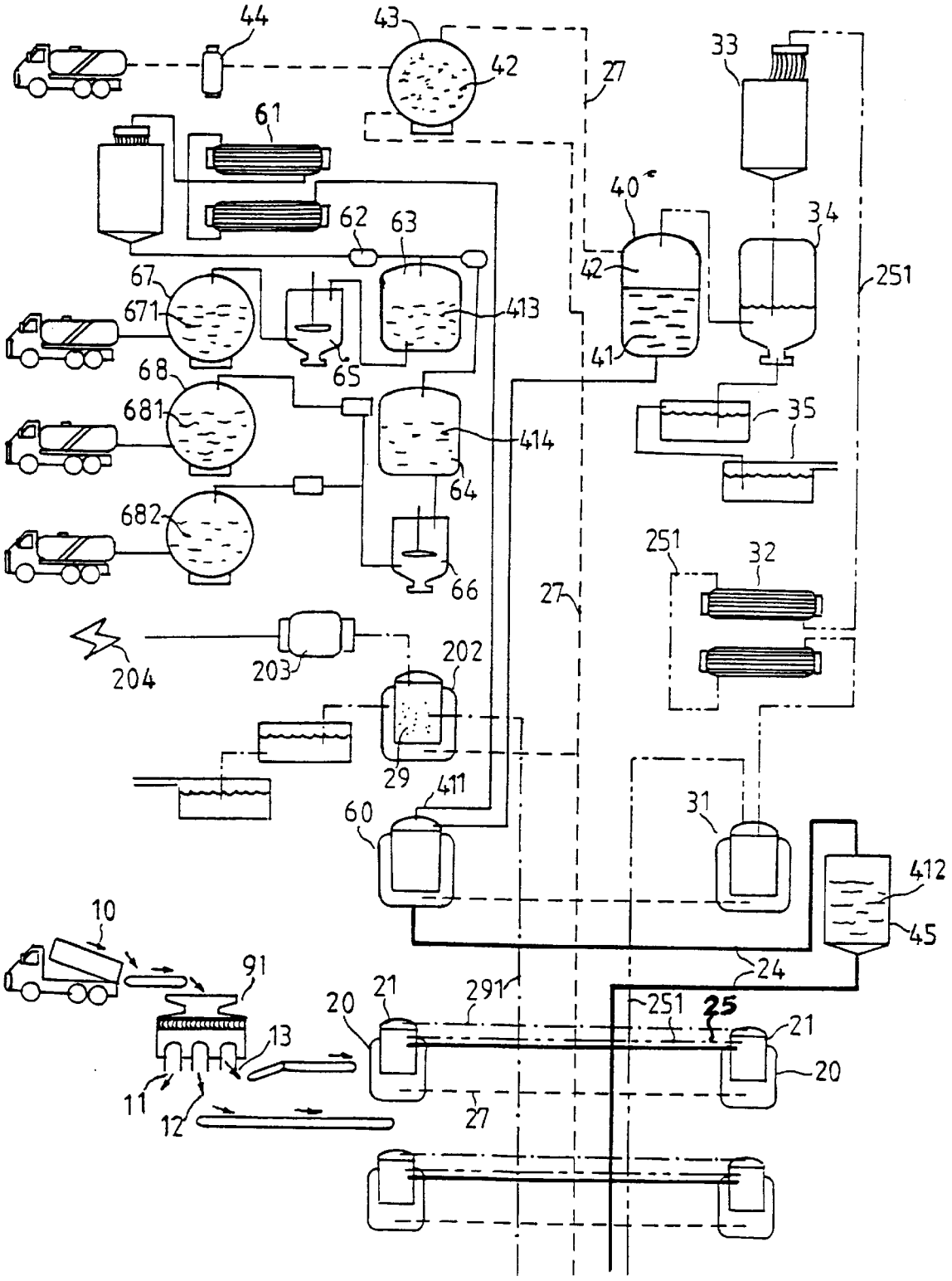
FIG. 2 is the flow sheet of related apparatus used in the process for energy recovery through waste classification and calcination according to the invention.
Figure 3:
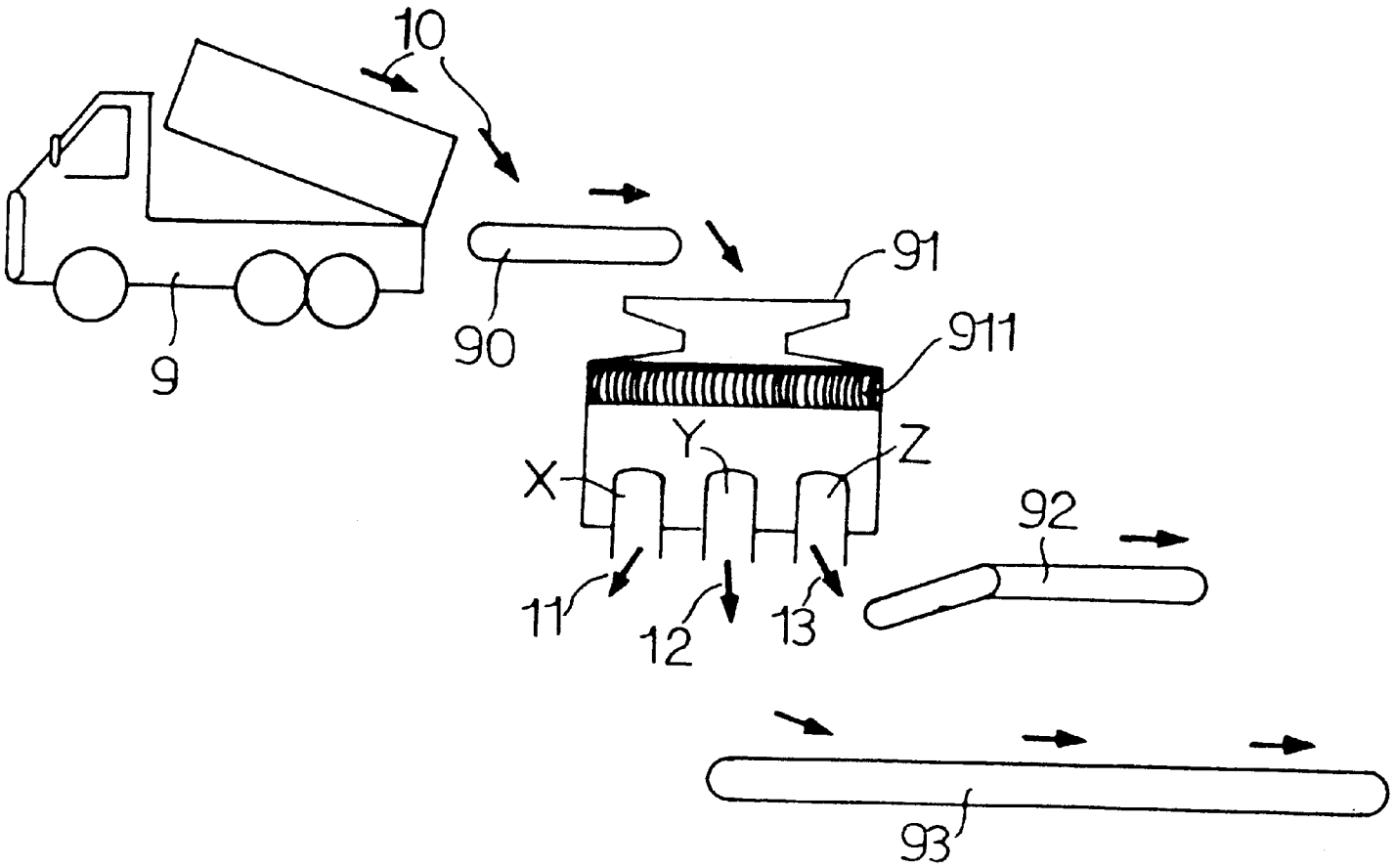
FIG. 3 is the flow sheet of related apparatus for waste sorting according to the invention.

Based on the process described above and with reference to FIGS. 2 and 3, the apparatus for energy recovery through waste classification and calcination according to the invention will be described in detail. The apparatus of the invention comprises: garbage wagon (9) which carries wastes (10) and which is unloaded onto a conveying belt (90) to convey wastes (10) to a crusher (91) equipped with a pulverator (911) therein for pulverizing wastes (10). Said pulverator can generate a huge wind power which can lower the water content of wastes and soil pulverized wastes based on their specific gravities. The wastes after sorting based on specific gravities can be classified into: mixed wastes (11), comprising metals, cans, synthetic resins, stone, wood, bamboo, concrete and so on, which are in a form of lump, and among which, larger wood blocks can be picked up for burning; organic wastes (12), comprising ordinary family kitchen garbages of vegetable and animal origins, and tree branches and leaves, which are pulverized into fine grains; and light weight wastes (13), comprising papers, clothes, plastic bags and the like, which are pulverized into pieces. These three types of wastes are discharged separately from outlets (X, Y, Z) of the pulverator (91), among which, mixed wastes (11) discharged out of outlet (X) can be disposed by landfill process; organic wastes (12) discharged out of outlet (Y) can be conveyed via conveying belt (23) to the conveying lines (23) of burning plate (23) in the calcining furnace (20); while light weight wastes (13) out of outlet (Z) can be conveyed via conveying belt (93) to the inlet (214) on the lid (213) of the cracking furnace (21) in the calcination furnace (20).

Figure 4:
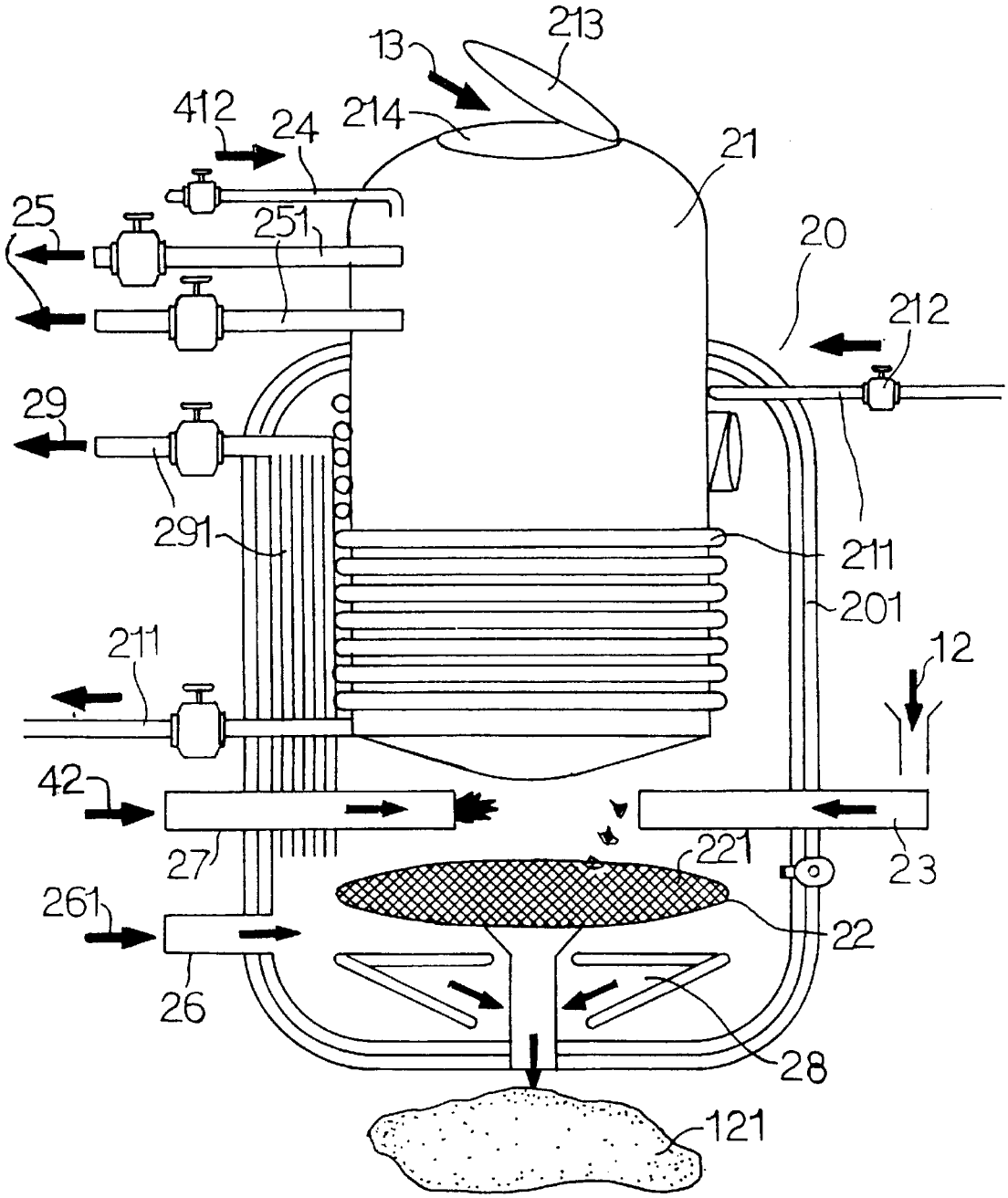
FIG. 4 is a diagram showing the structure of a calcination furnace for fusing plastic wastes according to the invention.

Now referring to FIG. 4, a diagram showing the structure of the calcination furnace (20) in the apparatus for energy recovery through wastes classification and calcination according to the invention, the furnace body (201) of said calcination furnace (20) is provided with a cracking furnace (21) at an appropriate place above, and around said furnace body (201), a cooling water lines (211) with a valve (212) at a suitable place thereon are provided, which can be used to regulate the flow rate of cooling water so as to control the temperature change in the cracking furnace (21). A lid (213) is provided on top of the calcination furnace, which can be opened for introducing light weight wastes (13) into the cracking furnace (21). The cracking furnace is connected with a heavy oil line (24) having a valve (241) which can control the amount of heavy oil flowing into the cracking furnace (21) (the heavy oil can be replaced by heavy petrols or light oil) for promoting the cracking of plastic wastes inside the cracking furnace (21). The cracking furnace is further connected with an oil gas line (251) which can recover oil gas (25) generated through the cracking of plastics contained in melted light weight wastes (13) in the cracking furnace. The heavy oil line (24) can be used further as a safety system in the case where light weight wastes (13) contain large amounts of foams or sponges which receive heat more quickly, or when the oil gas line (251) is blocked such that oil gas generated can not exit, which may lead to an increase of pressure inside the cracking furnace (21), then oils contained in the cracking furnace (21) can be discharged via the heavy oil line (24) into a heavy oil tank, and meanwhile, cool oil gas by means of the heavy oil line so as to prevent the risk of excessively high pressure.

At a lower part of the cracking furnace (21), a burning plate (22) is provided, around which plate (22) are equipped an air line (26), a gas line (27) and a waste conveying line (23). The waste conveying line (23) can spread organic waste (12) on the burning plate (22), and after being mixed with air (261) from the air line (26) and gas (42) from the gas line (27), the organic waste (12) can be burned on the burning plate (22), while heat generated during burning of the organic wastes can be transferred indirectly to the cracking furnace above the burring plate (22) so as to melt and evaporate plastics into oil gas (25), which is discharged via the oil gas line (251). In addition, since the burning plate (22) itself is provided with a plurality of holes (221) thereon and can rotate such that wastes (12) can be distributed uniformly thereon as well as ash (121) produced after burning of wastes can fall down through those holes (221) onto a mobile plate (28), when there is sufficient ashes (121) on the mobile plate, the weight of said ashes will force the mobile plate (28) tilt such that those ashes will flow automatically out of the furnace body (201) along the mobile plate. Further, at a suitable height inside the calcination furnace (20), there is provided a flue gas line (291) which can collect flue gas (29) having a high temperature of 600 C generated through burning of organic wastes (12) on the burning plate (22) and introduce said flue gas (29) into a secondary calcination furnace (202) where the temperature of said flue gas (29) can be raised to 1000 C, and by passing through a heat exchanger (203), it can form high pressure and high temperature air for use in a steam electricity co-generating system (204) included in the apparatus according to the invention.

After introducing light weight wastes (13) into the cracking furnace (21) of the calcination furnace according to the invention, an oil material (412) of a weight ratio of 1:10 (preferably a heavy oil, since its boiling point is above 400 C such that it can dissolve and vaporize plastics before boiling) is charged. Then, the furnace is closed and heated to 85–130 C for the first step heating to dissolve completely the plastic wastes. Thereafter, the temperature is increased gradually, gas evolution begins at about 200 C, and pressure increases dramatically. It should be noted that pressure control must be maintained carefully throughout the whole heating course by constantly discharging the internal oil gas (25) so as to keep the pressure at 4 Kg/cm2. Subsequently, heating is continued slowly to reach a temperature of 340–380 C where the plastic wastes in the furnace become sticky. When the temperature reaches 400–450 C, the gas production rate is the fastest, and while at 500 C, all gasifiable materials have been gasified and passed through the oil gas line to be subsequently processed. The residues (131) remains in the furnace comprise original filler and residual carbon which, after being cooled under reduced pressure, is in the form of a black light, porous sponge-like material which can be used as an adsorption agent or, depending on the nature of plastic waste, can be used to obtain products with commercial value such as coke, tar, active coke and so on. Moreover, due to its heat resistance and low thermal conductivity, they may be used to produce excellent materials such as carbon brick (a kind of advanced refractory brick), heat insulating materials and the like. In addition, after being ground by means of a grinding machine to a powder of a particle size of 2 mm, they can be used in heat insulating coatings for cars, and when the powder is mixed with sticky asbestos or other refractory material and water under stirring in a blender and then extruding and calcining, refractory bricks can be obtained.

Figure 5:
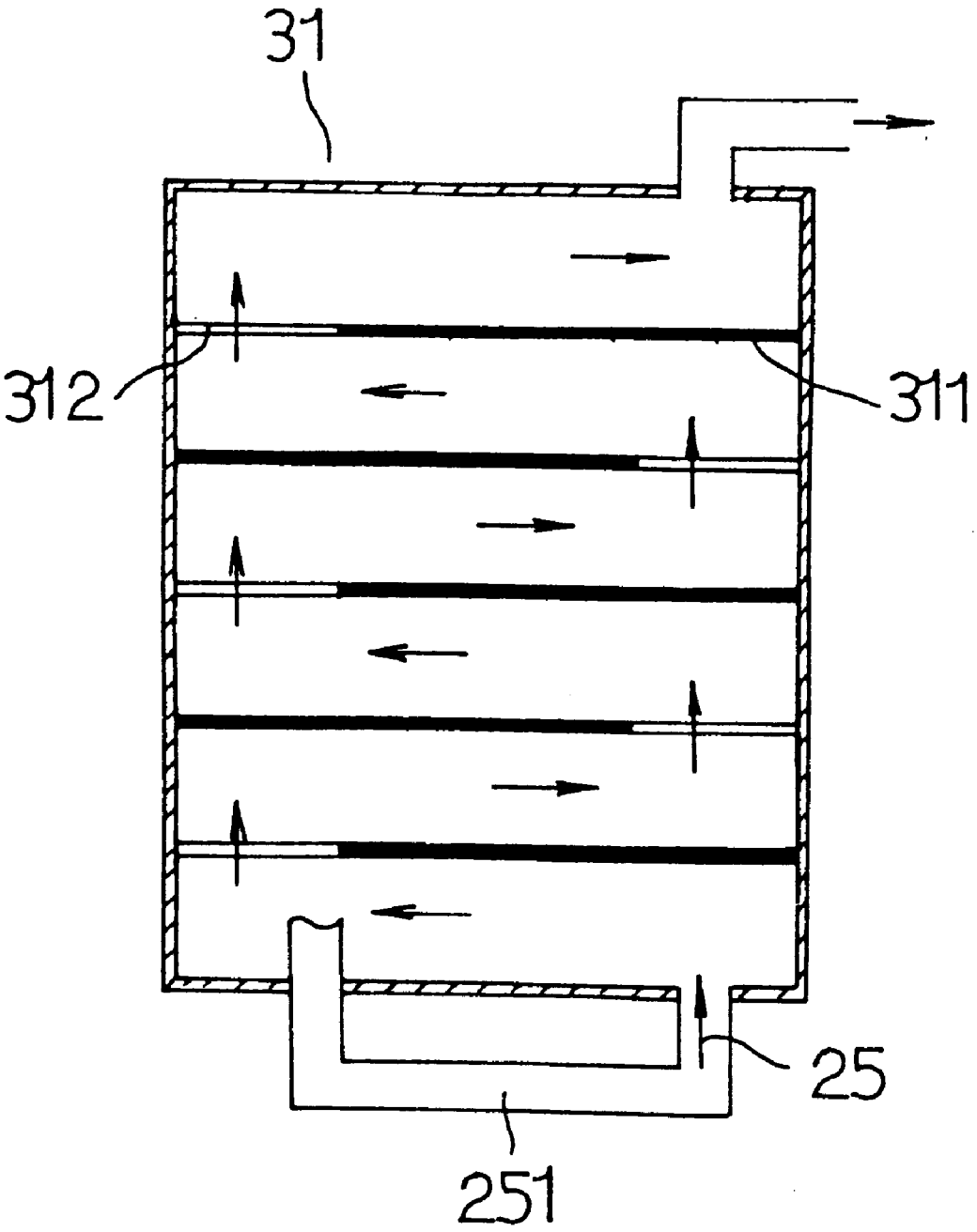
FIG. 5 is a schematic diagram showing the reaction furnace for the irreversible cracking reaction of oil gas according to the invention.

As shown in FIG. 5, reactor (31) is a rectangular heating apparatus having a number of internal horizontal spacers arranged along vertical axis (311), each of which has a screen plate (312) on one end thereof, wherein the screen plates on adjacent spacers are each on alternating opposite ends for communicating and those screen plates can be heated to 500–600 C with pressure controlled at 2 Kg/cm2. When gas (25) produced in the cracking furnace (21) of the calcination furnace is in a reversible state due to incomplete cracking, the degraded chains may be rearranged into the form of a liquid or gel, which might block the lines. In view of this, according to the invention, this oil gas (25) is introduced first into the reactor (31) for preheating, and then, by means of the retarding effect of the screen plates (312), macromolecules are released and cleaved gradually into small molecules, while the cracking process in the cracking furnace is continued so as to block the reverse reaction and at the same time, by controlling the temperature at about 400 C, cracking of molecules can be stopped while instant rearrangement or stabilization occurs so that the reverse reaction will not occur.

Furthermore, irreversibly cracked oil gas (25) is collected by a first condenser (32) and its temperature is lowered stepwise to about 100 C so as to stabilize completely the chemical state of the gas flow. Under this circumstance, macromolecules are converted into small ones and part of which have been condensed into liquid. Subsequently, the temperature of the oil gas (25) is lowered further down to an ambient temperature of about 35 C by means of a second condenser (33), where the oil gas (25) is subjected to precipitation in a precipitating tank (34) to remove contaminants in the liquid. These contaminants are discharged out of a waste water treater (35), while the cleaned filtrate is transferred into an oil/gas separating tank (40), to settle down liquid alkanes higher than C5 (crude oil) (41). On the other hand, noncondensed gaseous alkanes lower than C4 (42) are pressure liquified and stored in a gas storage tank (44), which, after removing hazardous contaminants in an aqueous washing tank, is packaged in cylinders (44) for selling or to supply fuel to the in-line calcinating furnace (20), the secondary calcination furnace (202), the reactor (31) and the fractionating column (60).

The crude oil (41) in the oil/gas separating tank (40) is delivered continuously into a fractionating column (60) where, under heating to about 450 C by burning gas, distillate (411) is condensed to 450° C. by a cooler (61) and then subject to stepwise distillation by means of a distiller (62), and the distillates are then collected and stored. The distillate (413) obtained at 200–450 C, having a quality close to diesel, is stored in an oil storing tank (63), while the distillate (414) obtained at 20–200 C having a quality close to gasoline, is stored in a second oil storage tank (64), and is transported to washing tanks (65, 66) for pickling, neutralizing and removing contaminants therein, and then, after removing trace water with activated clay and decoloring, can be recovered as diesel (671) and gasoline, to be stored in the diesel storage tank (67) and gasoline storage tank (68), respectively. Moreover, tetraethyllead can be incorporated into the gasoline obtained to formulate into advanced gasoline (681) which, after being incorporated with methyl butyl ether, can be formulated into leadless gasoline (682) for marketing at gas stations.

In addition, heavy oil (412) settled in fractionating column (60) can be recovered in the heavy oil storage tank (45), and subsequently used in the cracking furnace (21) of the calcination furnace (20).

Accordingly, the apparatus for energy recovery through waste classification and calcination not only can sort and treat wastes, but also can recover various energy sources in wastes (gas, diesel, advanced gasoline and the like), wherein part of the energy source can be used for maintaining operation of the invention, so that the invention can be practiced independently without addition of external energy sources.

Many changes and modifications in the above described embodiment of the invention can, of course, be carried out without departing from the scope thereof. Accordingly, to promote the progress in science and the useful art, the invention is disclosed and is intended to be limited only by the scope of the appended claims.

What is claimed is:

1. A process for energy recovery from waste, comprising:

crushing said waste;

sorting said crushed waste based on specific gravity into mixed waste, organic waste, and light weight plastic;

mixing said light weight plastic waste with a solvent;

treating said plastic waste and solvent mixture with heat to dissolve said plastic waste;

cracking said dissolved plastic waste into oil gas;

cracking said oil gas;

cooling said cracked oil gas stepwise to condense crude oil from said cracked oil gas;

recovering uncondensed cracked oil gas as fuel gas;

pressure liquifying said fuel gas;

fractionally distilling said crude oil, and collecting a distillate from said fractional distillation.

2. The process according to claim 1, wherein said process further comprises subjecting said distillates to pickling, neutralizing and removing contaminants, precipitating to bleach, and recovering as a product at least one of pure diesel oil and gasoline.

3. The process according to claim 2, wherein said solvent mixed with said light weight plastic waste is at least one member selected from the group consisting of heavy oil, petrols and light oil.

4. The process according to claim 2, wherein a residue from the heat treatment of the plastic waste and solvent mixture is cooled under pressure to form a black, light, porous sponge-like material useful as a raw material for refractory bricks.

5. The process according to claim 2, wherein a residue from the heat treatment of the plastic waste and solvent mixture is further processed to obtain such additional materials as coke, tar and active tar.

6. The process according to claim 2, wherein said cracking of said oil gas comprises:

heating said dissolved oil gas at 500–600° C., while controlling pressure at about 2 $kg/cm^2$, to continuously crack said oil gas, thereby gradually releasing and cleaving molecules rearranged in an irreversible reaction.

7. The process according to claim 2, wherein said fractional distillation of said crude oil comprises:

heating said crude oil to about 450° C. for fractional distillation, and collecting and storing said distillates resulting from heating at 20–200° C. and at 200–400° C.

8. The process according to claim 2, wherein said distillates are recovered and used as a heat source in the heat treatment of said plastic waste and solvent mixture.

9. The process according to claim 1, further comprising calcining said organic waste with gas to obtain high temperature heat energy; and using said high temperature heat energy as said heat for treating said plastic waste and solvent mixture.

* * * * *